US005099544A

United States Patent [19]

Yamamoto

[11] Patent Number: 5,099,544

[45] Date of Patent: Mar. 31, 1992

[54] VACUUM MOTOR SWITCH ACTUATOR

[76] Inventor: Sam Yamamoto, 2 Allen Manner, Unionville, Ontario, Canada

[21] Appl. No.: 580,153

[22] Filed: Sep. 10, 1990

[51] Int. Cl.[5] ..... A47L 9/28

[52] U.S. Cl. ..... 15/339; 15/314; 200/81.9 R

[58] Field of Search ..... 15/339, 314, 327.1; 200/81.9 R

[56] References Cited

U.S. PATENT DOCUMENTS

| | | | |
|---|---|---|---|
| 2,791,657 | 5/1957 | Bloxsom et al. | 200/81.9 R |
| 2,916,576 | 12/1959 | Croskey et al. | 200/81.9 R |
| 3,885,267 | 5/1975 | Maurer et al. | 15/339 |
| 4,933,516 | 6/1990 | Brown | 200/81.9 R |

FOREIGN PATENT DOCUMENTS

| | | | |
|---|---|---|---|
| 1590412 | 8/1970 | Fed. Rep. of Germany | 200/81.9 R |
| 2098399 | 11/1982 | United Kingdom | 200/81.9 R |

*Primary Examiner*—Chris K. Moore
*Attorney, Agent, or Firm*—Barry R. Lipsitz

[57] ABSTRACT

Vacuum cleaning apparatus is disclosed with built in air pressure supply lines for operating pneumatic tools. An air operated valve switch actuator is coupled between the pneumatic air pressure and the vacuum motor to make the vacuum motor operate simultaneously with the pneumatic tool. Preferably the vacuum motor operates for a short period after the tool is turned off. The switch actuator has a piston and cylinder arrangement with an inlet and outlet connected in series in the pneumatic pressure line. When the tool is turned on, a pressure drop in a valve chamber adjacent to the outlet causes the piston to move to a forward position where a plunger actuates a vacuum motor switch. When the tool is turned off, pressure is equalized in the valve chamber through a narrow bleeder or by-pass channel. When the pressure is equalized, a spring biases the piston to a rearward position to de-actuate the vacuum motor switch.

12 Claims, 3 Drawing Sheets

VACUUM MOTOR SWITCH ACTUATOR

BACKGROUND OF THE INVENTION

This invention relates to transportable industrial vacuum cleaning apparatus, and in particular to pneumatic switch actuators for operating same.

The combination of pressurized air lines for pneumatic tools and vacuum cleaning systems is commonly found in machine shops, paint shops and the like where constant cleaning is a necessary and mandated part of the shop routine or the tasks to be performed. Some pneumatic power tools, particularly dust forming tools such as sanders and sand blasters, are connected directly to both a vacuum line and a pressurized air line, the latter being required to operate the power tool, and the former to clean up the dust in order to keep the workplace clean.

Presently, in order to ensure that all of the dust is picked up by the vacuum cleaner, an operator turns on the vacuum cleaning apparatus before the power tool is turned on, and he either leaves the vacuum cleaning apparatus running while he turns the power tool off and on, or he turns the vacuum cleaning apparatus off after the power tool is turned off each time. This results in a lot of wasted time and effort and excess noise and wasted energy caused by the vacuum cleaning apparatus being operated when it is not needed.

SUMMARY OF THE INVENTION

The present invention provides an air operated valve actuator that operates a vacuum cleaner motor simultaneously with a pneumatic tool.

According to one aspect of the present invention, there is provided a vacuum motor switch actuator device comprising a tube having a bore therethrough, an open end and a closed end. A piston is mounted in the bore for reciprocal movement between a rearward and a forward position. The piston in said forward position is spaced from the closed end to define a valve chamber. The tube open end forms an inlet port adapted to be connected to a supply of gas under pressure. The tube is being provided with a outlet port which is spaced between the inlet port and the valve chamber and is adapted to be connected to a pneumatic tool. The piston is dimensioned to block and unblock substantially all of the flow of pressurized gas from the inlet port to the outlet port when in the respective rearward and forward positions. A switch is mounted adjacent to the tube closed end and is adapted to be activated by contact with the piston when in the forward position. Means defining a bleeder passageway connects the inlet port to the valve chamber for gas pressure equalization therebetween when gas flow through the outlet port is obstructed by the pneumatic tool. Also, means is provided for resiliently biasing the piston toward the rearward position, so that the piston moves to the rearward position when pressure is equalized in the tube.

According to another aspect of the invention there is provided a combination vacuum cleaning apparatus and pneumatic air pressure source comprising a housing and a vacuum cleaning means mounted in the housing and having a vacuum motor for sucking air through a suction hose adapted to be attached to the housing. A pneumatic pressure line is mounted in the housing for supplying pressurized air to a pneumatic tool adapted to be connected thereto. A vacuum motor switch actuator device as described above is connected with the inlet port and outlet port thereof connected in series in the pneumatic pressure line and the switch thereof being operably connected to the vacuum motor.

BRIEF DESCRIPTION OF THE DRAWINGS

Preferred embodiments of the invention will now be described by way of example with reference to the accompanying drawings, in which.

DETAILED DESCRIPTION OF THE PREFERRED EMBODIMENTS

Figure 1:
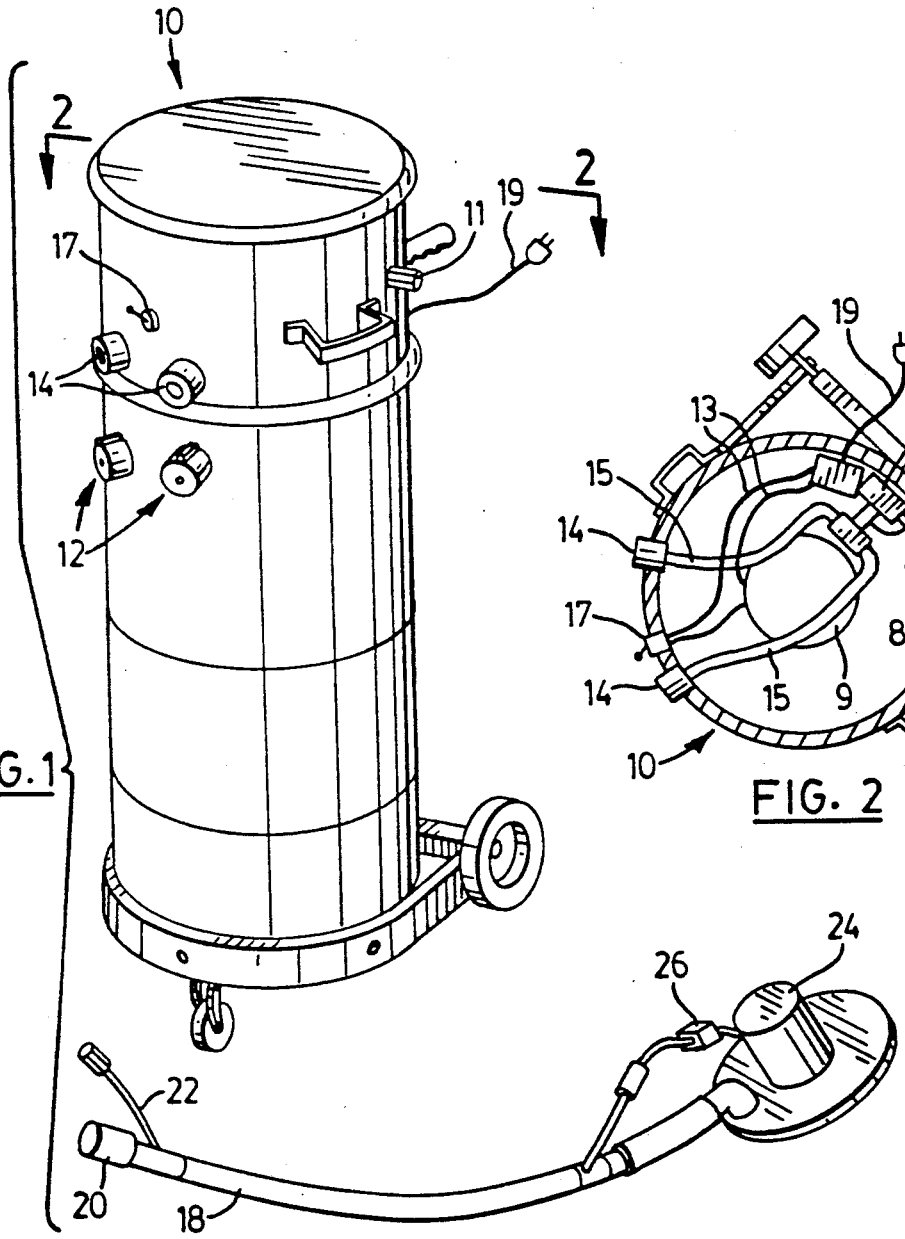
FIG. 1 is a perspective view of a combination vacuum cleaning system and pressurized air line system in conjunction with a power tool.
Figure 2:
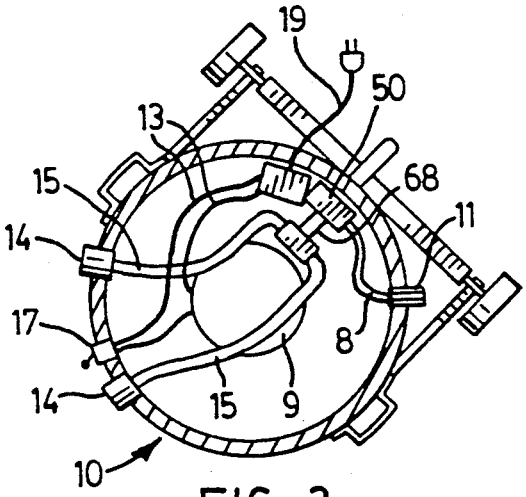
FIG. 2 is a sectional view taken along lines 2—2 of FIG. 1.

Referring first to FIGS. 1 and 2, a preferred embodiment of a time delay switch actuator 50 according to the present invention is shown interconnecting a pressure air line 8 and a vacuum motor 9 of a vacuum cleaning apparatus 10 used in a typical machine shop setting. A quick disconnect coupling 11 is used to supply pneumatic or pressurized air to air line 8 and thus actuator 50. Quick disconnect high pressure air outlet ports 14 are connected through suitable hoses 15 to switch actuator 50. Switch actuator 50 is operatively connected through electrical wires 13 to vacuum motor 9. A manual switch 17 is connected to motor 9 and in parallel with actuator 50 to manually turn on vacuum motor 9 if desired. A power supply cord 19 supplies suitable electrical power to operate motor 9.

Vacuum apparatus 10 includes a pair of quick disconnect vacuum outlet ports 12 each connected internally through a suitable filter device (not shown) to vacuum motor 9 contained in apparatus 10.

A vacuum hose 18 includes a vacuum line 20 and an air line 22 which are coupled to one of each of the outlets 12 and 14 respectively when in operation. A second vacuum hose can optionally be connected to the other set of outlets 12 and 14 if desired. A power tool 24 such as a sander or grinder, is connected at the other end of hose 18. Power tool 24 includes an air flow on/-off switch or valve 26 to operate power tool 24.

Figure 3:
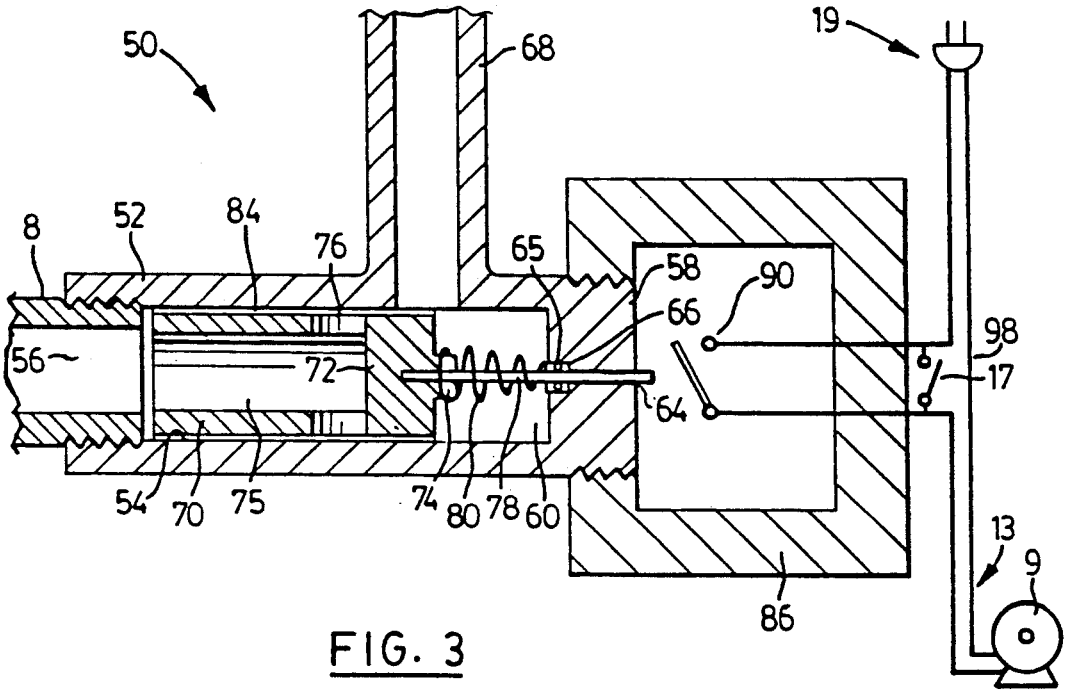
FIG. 3 is a vertical sectional view of a preferred embodiment of a differential pressure-activated time delay switch actuator of the present invention in the rearward position.
Figure 4:
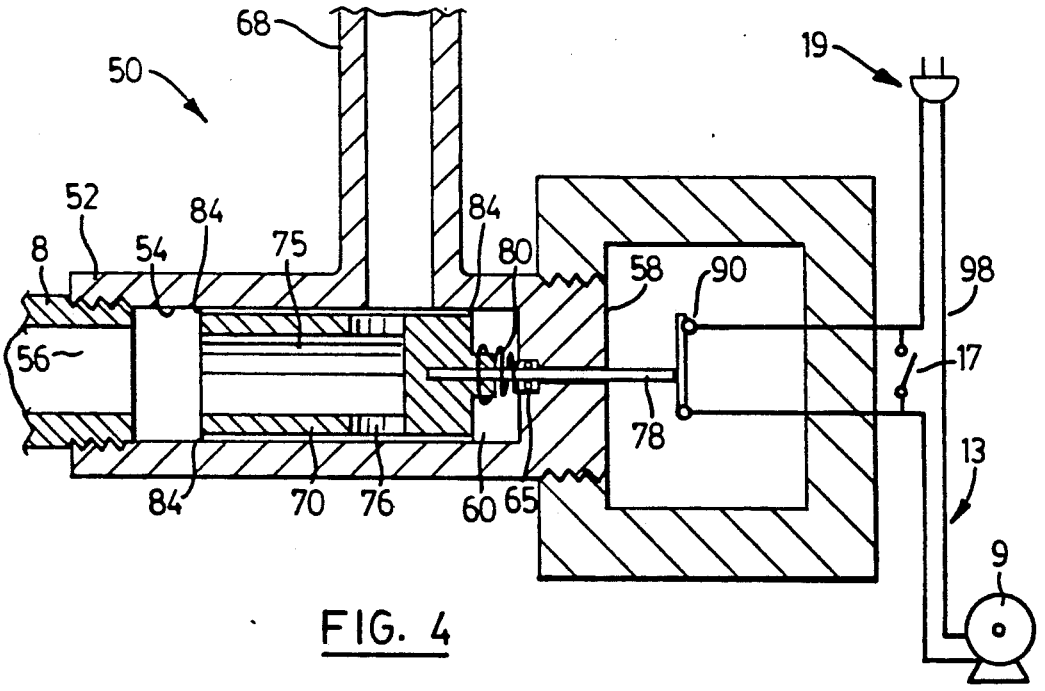
FIG. 4 is a vertical sectional view similar to FIG. 3 but showing the time delay switch actuator of the present invention in the forward position.

Referring next to FIGS. 3 and 4, a preferred embodiment of the time delay vacuum motor switch actuator 50 will now be described. Actuator 50 includes a tube 52 having a bore 54 therethrough, an open entrance or inlet end 56 and an opposite closed end 58. Entrance end 56 is in the form of a pressurized air inlet port and is connected to pressure air line 8 (See FIG. 2). Closed end 58 includes a hole 64 through the center along the bore axis. Tube 52 is provided with a side wall air outlet port 68 spaced from closed end 58. Outlet port 68 is connected to hoses 15 through a suitable T or Y fitting as seen best in FIG. 2.

A loosely fitting piston 70 is reciprocally or slidably mounted in bore 54 between a rear position as seen in FIG. 3, and a forward position as seen in FIG. 4. In the forward position, piston 70 is spaced from closed end 58 to define a valve chamber 60. Outlet port 68 is spaced between the inlet port 56 and valve chamber 60.

Piston 70 is provided with a piston head 72 which has a cylindrical raised portion or boss 74. Piston 70 is also provided with a hollow central passageway 75 and plurality of side wall orifices 76 situated behind piston head 72 in communication with central passageway 75. A plunger 78 rigidly secured to piston head 72 extends along the bore axis and into hole 64. A conical compression spring 80 is attached at one end to head 72 by being fitted snugly over raised portion 74. Spring 80 extends longitudinally along the bore axis and is concentric with plunger 78. Hole 64 has a counterbored portion 66 containing an O-ring 82 to seal plunger 78 and prevent gas from passing through closed end 58. The inner wall of tube 52 and the sidewall of piston 70 define a narrow bleeder passageway 84 therebetween. The purpose of which will be described further below.

A switch housing 86 is threaded onto closed end 58. Housing 86 contains a vacuum motor microswitch 90 which is connected in series between power supply cord 19 and vacuum motor 9 by wires 13. Manual switch 17 is connected in parallel with switch 90 to operate vacuum motor 90 manually if desired.

In operation, with the valve 26 of pneumatic tool 24 closed, no air flows through actuator 50 since air flow is blocked by piston 70, it being in the rearward or closed position. Piston 70 is resiliently biased by spring 80 into the rearward position (see FIG. 3). Opening valve 26 starts the flow of pressurized air into tube 52 through inlet port 56 and causes a pressure drop between inlet port 56 and outlet port 68 to drive piston 70 and associated plunger 78 forward to actuate switch 90. When piston 70 is driven to the forward position as illustrated in FIG. 4, at least on of the piston side wall orifices 76 will be aligned with sidewall outlet port 68 unblocking the flow of air through tube 52. Pressure in valve chamber 60 is lower than the pressure on the inlet port side of piston head 72, so piston 70 is held in the forward position hence maintaining switch 90 closed.

When the gas flow is interrupted or stopped such as by closing valve 26, air pressure in outlet port 68 rises to equal the pressure in inlet port 56. However, the pressure in valve chamber 60 remains lower for a short period, such as a few seconds, until the high pressure bleeds through bleeder passage 84 to equalize the pressure in valve chamber 60. When this happens, piston 70 begins to move toward the rearward position due to spring 80 exerting a greater force rearwardly than the now diminished pressure holding piston 70 in the forward position. In other words, differential pressure exists between inlet port 56 and valve chamber 60 which begins to equalize as air leaks via bleeder passageway 84 from the high pressure side to the low pressure side in valve chamber 60 thereby diminishing the force holding piston 70 forward. Upon equalization of the pressure piston 70 will be biased toward the rearward position where plunger 78 will be fully disengaged from switch 90. The time required for piston 70 to reach the rearward position and hence the time delay or dilatory disengagement of plunger 78 from vacuum motor switch 90 is dependant on the time needed to equalize the pressure which in turn is determined by the dimensions of bleeder passageway 84. A bleeder passageway with a width of between 0.005 inches–0.010 inches and a length of about 0.5 inches results in a pressure equalization time of approximately 2–3 seconds for a line pressure in the range of 75–125 psi.

In one aspect the apparatus of the present invention is a pressure/translational motion transducer providing a dual speed switch actuator with the forward plunger velocity determined by the inlet port air pressure, the piston weight and the spring constant. Conversely, the rearward plunger velocity is determined by the spring constant and the pressure equalization time which in turn is determined by the gas bleeder passageway dimensions.

The tube may be constructed of metal or alternatively made from a rigid plastic material such as teflon or polyethylene. The piston is preferably fabricated from a hard plastic material which will not grab the tube during reciprocation of the piston therein, preferably a hard plastic such as teflon or polyethylene. The plunger can be a metal rod such as stainless steel. The O-ring may be fabricated from a resiliently deformable rubber such as viton or other similar materials.

Figure 5:
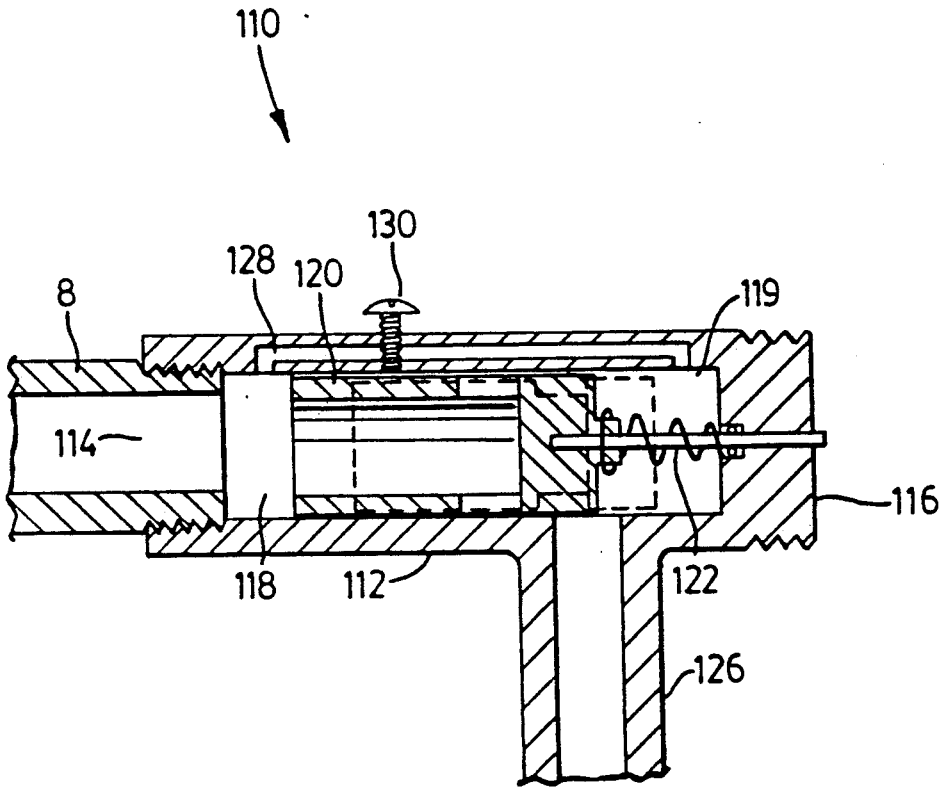
FIG. 5 is a vertical sectional view of an alternative embodiment of a time delay switch actuator according to the present invention.

Referring now to FIG. 5, an alternative embodiment of a time delay vacuum motor switch actuator is generally indicated by reference numeral 110. Actuator 110 includes a tube 112 having an input port 114, a closed end 116 and a bore 118 therethrough. A piston 120 is mounted for reciprocal movement in bore 118 and a valve chamber 119 is located between closed end 116 and piston 120 when it is in the forward position as indicated by the dotted lines in FIG. 5.

A plunger 122 is rigidly attached to piston 120 to reciprocate therewith. Tube 112 is further provided with a side wall mounted air outlet port 126 spaced from closed end 116. Tube 112 is provided with a side wall gas bleeder passageway 128 connecting input port 114 and valve chamber 119. Bleeder passageway 128 is provided with an adjustable needle valve or set screw 130 for controlling the flow rate through passageway 128. A vacuum motor switch (now shown) is mounted on closed end 116 and oriented so that it can be actuated by plunger 122 as in the case of the embodiment shown in FIGS. 3 and 4. By adjusting needle valve 130, the air pressure equalization time can be readily and accurately controlled thereby controlling the time delay between the termination of the air flow through outlet port 126 and the disengagement of plunger 122 from the vacuum motor switch.

In some cases, it may be desirable that there be no time delay and that the vacuum motor simply operate simultaneously with the pneumatic tool. In these cases, bleeder passageways 84 and 128 would be made large enough for there to be instant pressure equalization between the inlet port and the valve chamber when the pneumatic tool is turned off.

It will be understood that other variations could be made to the vacuum motor switch actuator of the present invention. For example, a piston with a longer piston head than that embodied in FIGS. 3 to 5 may be employed to be driven forward by the pressurized air flow to depress a resiliently biased push button switch mounted in valve chamber 119 with the push button part of the switch arranged to be contacted by the piston head. In this case, plunger 122 could be eliminated. The wires connecting the push button switch would pass through the wall of tube 112 or closed end 116 as desired.

It will be appreciated that the differential pressure activated time delay switch actuator of the present invention can also be utilized as a mechanical slow blow fuse. In many industrial applications pressurized gas flow systems are used in conjunction with other gas flow systems and/or electrical systems wherein a sudden drop in pressure in the former can represent a dangerous situation. In such systems, it is usual to have pressure sensors trip interlock systems upon sensing the loss in pressure which results in the irreversible turning off of the associated gas flow and electrical systems. This is routine if for example the pressurized gas is used as a coolant or alternatively is a reactant in a batch process. A disadvantage of irreversibly shutting down the associated systems is that even if the pressure loss is only momentary and unlikely to cause any damage, the associated systems will be shut off regardless. The time delay switch actuator of the present invention can be readily adapted to such flow systems at for example elbow joints, whereby if a sudden pressure drop occurs, the piston starts to slowly move to the rearward position as the pressure on either side of the piston starts to equalize. If the pressure is restored to its normal value in a time shorter than the present time delay, then the piston is returned to its forward position thus circumventing tripping off the associated systems. A variable present time delay can be chosen using the time delay switch embodied in FIG. 5.

While the present invention has been described an illustrated with respect to the preferred and alternative embodiments it will be appreciated that numerous variations of these embodiments may be made without departing from the scope of the invention, which is defined in the appended claims.

What is claimed is:

1. A switch actuator device, comprising: a tube having a bore therethrough, an open end and a closed end; a piston mounted in the bore for reciprocal movement between a rearward and a forward position, the piston in said forward position being spaced from the closed end to define a valve chamber; the tube open end forming an inlet port adapted to be connected to a supply of gas under pressure, and the tube being provided with an outlet port spaced between the inlet port and the valve chamber adapted to be connected to a pneumatic tool; the piston being dimensioned to block and unblock substantially all of the flow of pressurized gas from the inlet port to the outlet port when in the respective rearward and forward positions; a switch mounted adjacent to the tube closed end and adapted to be activated to contact with the piston when in the forward position; means defining a bleeder passageway open at all times connecting the inlet port to the valve chamber, said bleeder passageway dimensioned to provide a flow rate therethrough such that there is a time delay in gas pressure equalization which causes a time delay in the piston returning to the rearward position when gas flow from the inlet port to the outlet port is stopped; and means for resiliently biasing the piston toward the rearward position and for maintaining the piston spaced away from the closed end, so that the piston moves to the rearward position when pressure is equalized in the tube.

2. A switch actuator according to claim 1 wherein the piston is loosely fitting in the bore, the bleeder passageway being defined by the space between the piston and the bore.

3. A switch actuator according to claim 1 wherein the tube has a side wall chamber extending from the inlet port to the valve chamber to form the bleeder passageway.

4. A switch actuator according to claim 3 and further comprising a needle valve means mounted in the bleeder passageway for adjusting the gas flow rate therethrough.

5. A switch actuator according to claim 1 wherein the piston is provided with a central passageway and a plurality of side wall orifices communicating therewith, and wherein at least one of said orifices is aligned with the outlet port when the piston is in the forward position for unobstructed flow of gas therethrough.

6. A switch actuator according to claim 1 wherein the piston includes a plunger for actuating the switch.

7. A switch actuator according to claim 7 wherein the switch is mounted on the closed end of the tube, and plunger slidably extending through said closed end to contact the switch.

8. A switch actuator according to claim 1 in which the resilient biasing means is a spring.

9. A switch actuator according to claim 1 wherein the tube is formed of metal and the piston is fabricated from a rigid plastic material.

10. A combination vacuum cleaning apparatus and pneumatic air pressure outlet comprising:

a housing;

vacuum cleaning means mounted in the housing having an electric motor driving a suction fan for sucking air through a vacuum hose adapted to be attached to the housing;

a pneumatic pressure line having an air pressure outlet mounted in the housing said pressure line being adapted to be connected to a pneumatic air pressure source; and a switch actuator device according to claim 1, the inlet port and outlet port thereof being connected in series in the pneumatic pressure line and the switch thereof being operably connected to the electric motor.

11. A combination vacuum cleaning apparatus and pneumatic air pressure outlet as claimed in claim 10 wherein the bleeder passageway is dimensioned to provide a flow rate therethrough such that there is a time delay in gas pressure equalization when gas flow from the inlet port to the outlet port is stopped.

12. A switch actuator according to claim 1 wherein the resilient biasing means is a spring located between the closed end and the piston.

* * * * *